US005813183A

United States Patent [19]

Attley

[11] Patent Number: 5,813,183

[45] Date of Patent: Sep. 29, 1998

[54] METHOD OF COATING

[76] Inventor: Begona Attley, The Green, Horton-cum-Studley, Oxfordshire 0X9 1AY, Great Britain

[21] Appl. No.: 750,199

[22] PCT Filed: Jun. 12, 1995

[86] PCT No.: PCT/GB95/01368

§ 371 Date: Dec. 2, 1996

§ 102(e) Date: Dec. 2, 1996

[87] PCT Pub. No.: WO95/34384

PCT Pub. Date: Dec. 21, 1995

[30] Foreign Application Priority Data

| | | | |
|---|---|---|---|
| Jun. 14, 1994 | [GB] | United Kingdom | 9411877 |
| Oct. 18, 1994 | [GB] | United Kingdom | 9421004 |
| Nov. 2, 1994 | [GB] | United Kingdom | 9422126 |

[51] Int. Cl.[6] ..... E04D 1/22

[52] U.S. Cl. ..... 52/311.1; 52/177; 52/519; 52/745.19

[58] Field of Search ..... 52/177, 311.1, 52/519, 745.19

[56] References Cited

U.S. PATENT DOCUMENTS

| | | | |
|---|---|---|---|
| 4,243,696 | 1/1981 | Toth | 118/320 X |
| 4,528,231 | 7/1985 | Lund | 52/177 X |
| 5,475,951 | 12/1995 | Litzow | 52/177 |
| 5,632,123 | 5/1997 | Erwin | 52/177 |

*Primary Examiner*—Christopher Kent
*Attorney, Agent, or Firm*—Paul E. Milliken; Lee A. Germain

[57] ABSTRACT

A method of coating a component part (10) with a protective coating having a rough surface appearance in which the surface is covered with a first layer (L1) of powder coating, a particulate material (26) is spread over the first layer (L1) whilst the layer is tacky, and a second layer (L2) of powder coating is applied over the particulate material (26) and first layer and caused to coalesce. The method is particularly suitable for coating roofing materials to give the appearance of slate, stone, terra-cotta.

10 Claims, 2 Drawing Sheets

METHOD OF COATING

FIELD OF THE INVENTION

This invention relates to coating materials with a protective coating having a rough, dull or granular surface appearance. The invention relates particularly to building materials such as sheet roofing materials which may be coated to resemble for example, ceramic, slate, stone, cement or terracotta tiles.

BACKGROUND OF INVENTION

In WO9322523A there is described a shaped and embossed pressed sheet metal roof tile. In order to both protect the sheet metal, usually steel, and to give it the appearance of slate, or stone, etc., it is desirable for the surface to have a textured effect. It may also be desirable to coat mineral fibre filled cement roofing sheets in order to provide a uniform appearance and so that they resemble slate, stone, or other traditional roofing materials.

STATEMENT OF INVENTION

The present invention provides a protective coating especially for building materials which has the desired surface texture for resemblance to traditional materials.

According to the invention there is provided a method of coating a component part with a protective coating having a rough surface appearance wherein at least a portion of its surface is covered with a first layer of powder coating, a particulate material is spread over the first layer whilst said layer is in a soft condition, and a second layer of powder coating is applied over the particulate material and first layer and caused to coalesce.

The polymers used for powder coating can be divided into two groups, thermosetting powders and thermoplastic powders. Thermosetting powders are low molecular weight materials that cross link on heating after being applied to substrates. Thermosetting powders typically include epoxy resins, acrylics, and polyesters. Thermoplastic powders do not involve a chemical reaction and typically melt on application to either to hot substrates or by the subsequent application of heat. Thermoplastic powders include cellulose acetate butyrate, polyesters, vinyl polymers, polyamides, polyolefines and Ionomers.

Preferably the first layer is a thermoplastic powder coating material and the second layer may be the same material or is preferably a thermosetting powder coating, preferably a polyester.

The component part may be a metal part or a mineral part.

Mineral includes ceramics, asbestos, glass, and cement, as well as naturally occurring minerals and preferably the coating is applied to a sheet material such as sheets of mineral fibre filled cement.

Preferably the coating is applied to building materials such as sheet metal roofing materials, mineral fibre filled roofing sheets, sheet metal roofing tiles, or sheet metal or cement wall sections.

Preferably the particulate material is mineral dust or other granular material. The mineral dust may be formed from granite, slate, limestone, quartz, marble, brick dust, cement dust and any mixture thereof.

Granular materials may have an average particle size of between 2–3 mm and may include sand, or metal particles such as steel brass or bronze particles as well as the above minerals.

The presence of mineral dust or granular material helps dull the surface appearance of the sheet materials and can also be used to pigment the powder coating to a desired colour, for example slate dust can pigment white or non-pigmented powder to the colour of slate. It also provides a non-slip surface for roofing materials which may be walked on.

The powder coating can be applied to a metal substrate by either electrostatic fluidized-bed or by electrostatic spray techniques. Preferably the powder coatings are applied by electrostatic spray techniques. In the case of none-conductive materials the power coating can be blown or cascaded onto the surface of the component.

The above method can be utilised in particular for coating fabricated sheet metal roof tiles.

Also according to the invention there is provided a component part which is decorated to give the appearance of a mineral, stone, or ceramic material, wherein at least a portion of the surface of said part is coated by a first layer of powder coated polymeric material having particulate material scattered thereon with a second layer of powder coated polymeric material coating both the first layer and the particulate material.

Preferably the second layer of polymeric powder coating material is a different material to the first layer.

Preferably the particulate material is mineral dust or granules has an average size of between 2–3 mm and is preferably a granulated or crushed mineral such as sand, granite, slate, limestone, quartz, marble and any mixture thereof, or may be metallic particles such as steel, or brass, or bronze particles.

A building material, especially for roofing, according to the invention has an external surface coated to resemble brick, slate, terracotta, cement, stone, or other traditional materials.

The invention also includes apparatus for coating a component part, preferably in substantially flat or sheet form, with a protective coating having a rough surface appearance in which at least a portion of its surface is coated with a first layer of a powder coating and a particulate material is scattered across said surface, wherein the apparatus includes a hopper for storage of the particulate material which is located above a pair of side by side rollers and the particulate material is fed between the two rollers to drop as a curtain onto a component part moving transversely relative to the curtain on said conveyor.

At its broadest the invention provides a method of coating a component part with a coating having a rough appearance wherein at least a portion of its surface is covered in a layer comprising powder coating and particulate materials. The particulate materials and powder may be mixed together before application.

BRIEF DESCRIPTION OF DRAWINGS

The invention will be described by way of example and with reference to the accompanying drawings in which.

DETAILED DESCRIPTION OF INVENTION

Figure 1:
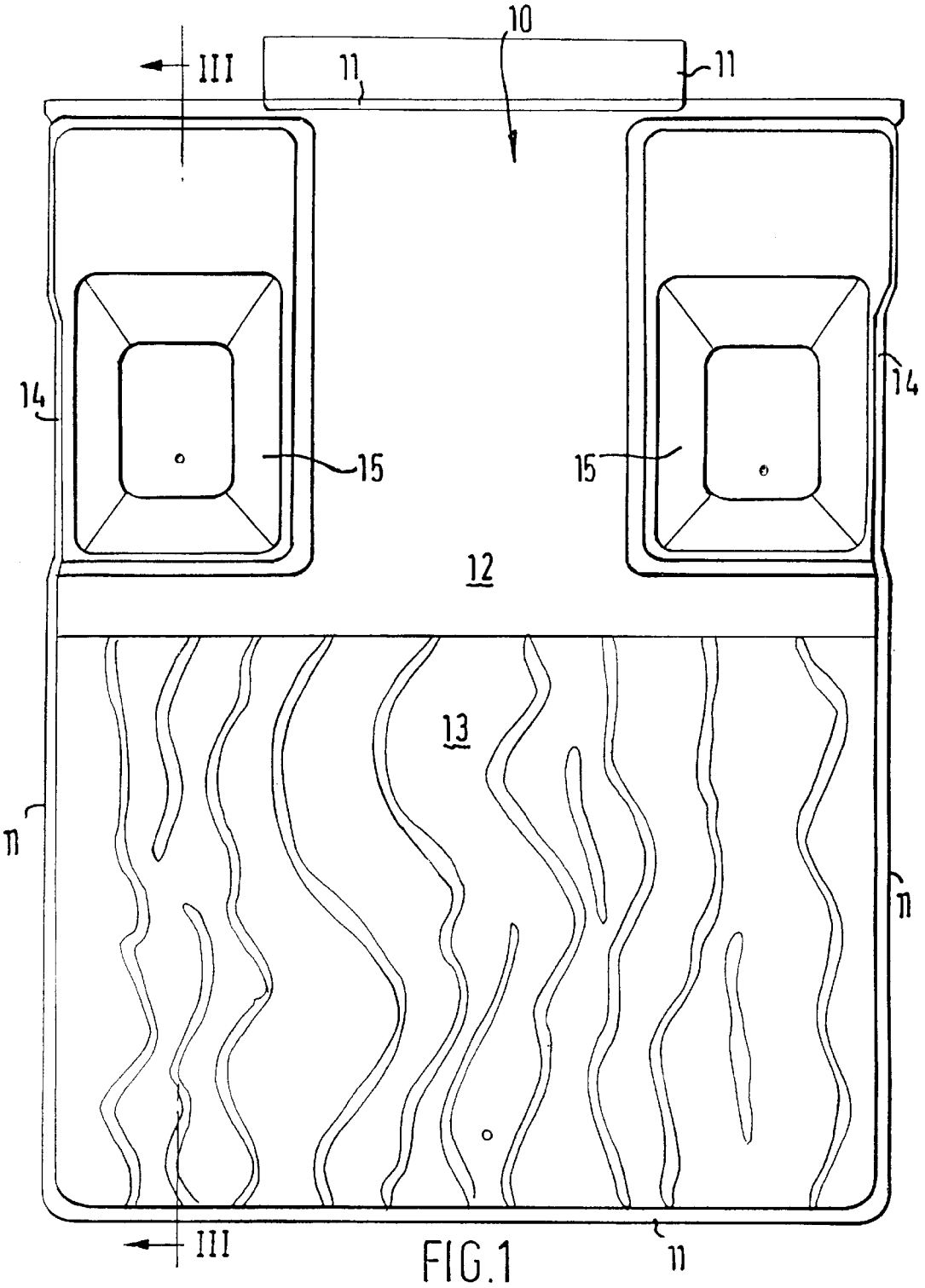
FIG. 1 is a fabricated roof tile as shown in WO93/22522 and which will be coated by a method according to the present invention.
Figure 3:
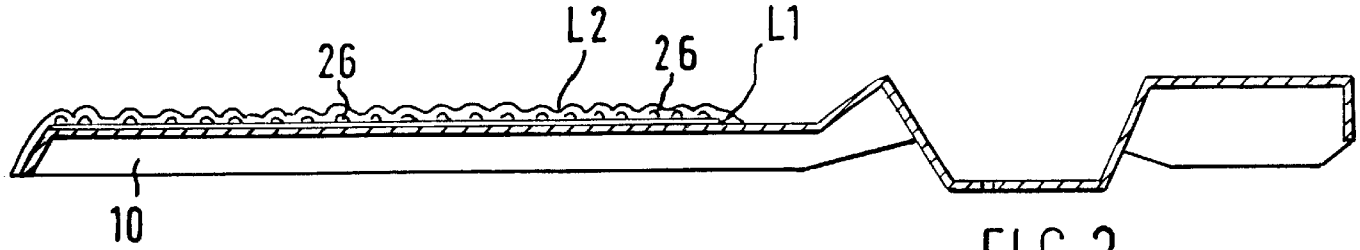
FIG. 3 is a cross-section through a roof tile of FIG. 1 showing the layers of coating.

With reference to FIG. 1, there is illustrated a sheet metal, preferably steel, roof tile (10) in which the sheet material tile is strengthened by integral flanges (11), raised bosses (14), and depressions (15).

The raised bosses (14) in use act as supports between one tile and an overlapping portion of another tile. The lower portion (13) of the upper surface (12) of the tile coated with a granular material to give a surface effect which when viewed from the ground resembles the surface of a slate, stone, terracotta or concrete tile.

The steel tile (10) may have a clean bare metal finish, and could be shot blasted to provide a surface key, or phosphated, etc. The tile is decorated as will be described below.

Figure 2:
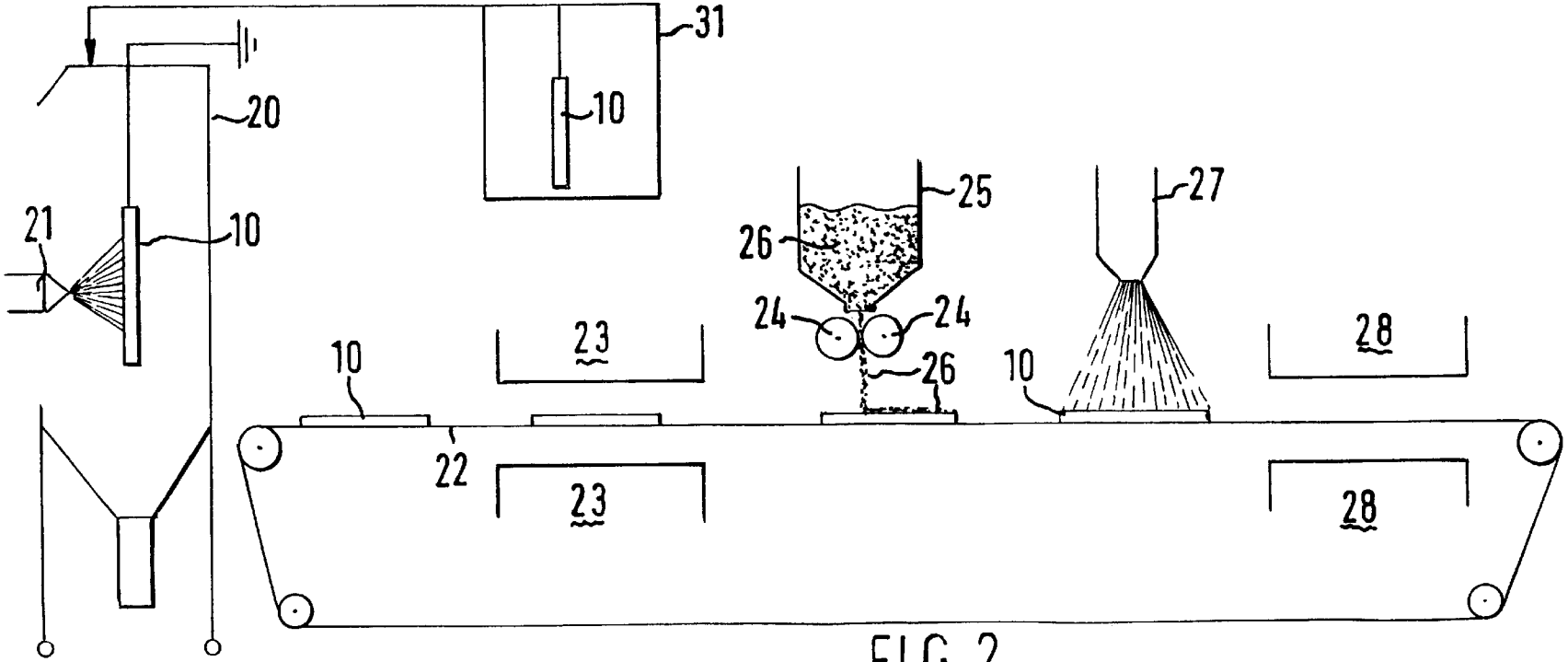
FIG. 2 is a schematic picture showing the method of apparatus according to the present invention.

Now with reference to FIG. 2, a flat roofing material in the form of a sheet metal roofing tile (10) as described above, or a sheet metal roofing panel, or a mineral fibre filled cement roofing sheet is passed through a coating apparatus. Metal panels or tiles (10) are passed through an electrostatic powder coating apparatus (20) in which both sides of the tile are covered in polymeric powder discharged from a electrostatic spray gun (21). In this example the powder is a thermoplastic powder coating having a high positive charge with the tile (10) being earthed or grounded through the coating apparatus. In the case of none-conductive material panels such as mineral fibre filled cement panels the powder may be cascaded or blown onto the surface.

A suitable thermoplastic which softens on exposure to a temperature of 150–220 degrees Centigrade for ten minutes is available from Fuller Coatings under the reference TP1, and preferably has powder grain sizes in the range of 0.1–1.2 mm, and preferably 150–700 microns.

Alternatively a metal tile could be coated using electrostatic fluidized bed coating techniques.

A powder coating density of about 1 kg per 10 square meters is preferred.

The sheet or tile (10) is then placed onto a conveyor belt (22) which passes the tile through an oven (23) preferably heated by radiant heat and which has a mean temperature of between 120–220 degrees centigrade, preferably 150 degrees, and a length of between 2–3 meters. The oven has three spaced apart banks of 100 Kw infra-red heaters arranged at a variable height above the conveyor, and preferably set at about 15 cms above the tile (10).

The linear speed of the conveyor is about 7 meters per minute so that the powder is heated for between 20–30 seconds. The thermoplastic coating on the tile begins to coalesce and presents a soft and tacky coating layer L1 on emerging from the oven.

The tile (10) or sheet then passes beneath a pair of side by side counter rotating rubber rollers (24) located beneath a hopper (25) housing particulate material (26). The particles (26) could be any mineral, or powdered metal but slate or a quartz/marble mixture are preferred since they do not normally require drying. A mixture of dust and granules may be used. The size of any granules is generally between 2–3 mm. The rolls are located between 15–30 cms above the surface of the conveyor 22.

When dropped from that height after passing through the rollers (24) the particles will adhere to the soft first layer. The particles (26) when dropping form a vertical curtain extending transversely to the tiles (10) so that as the tiles move with the conveyor (22) relative to the curtain of falling particles (26) they are distributed to cover substantially the whole upper surface of the tile and adhere to the sticky first layer of powder coating.

The sheets or tiles (10) are then passed under an air head (27) or a alternatively a cascade which covers the adhered particles (26) in a second layer of powder coating material which may be the same material as the first layer, but is preferably a thermosetting powder coating material, preferably a polyester.

The sheets or tiles (10) then pass through a second oven (28) preferably a radiant heat oven (28) about 7 meters in length and at a mean temperature selected to suit the material, but which will be typically between 150°–250° C., and preferably at about 150°–170° C., to cure the thermosetting layer L2 holding the particles in place and allowing the individual particles to protrude from the coating forming a roughened or granular surface effect.

The second layer of powder coating could be coloured by the inclusion before application of mineral dust and/or other pigment to give the required surface coloration and/or texture to resemble a particular traditional material.

A similar technique could be used for making fabricated wall sections resemble traditional materials, like brick work. A first layer of coloured plastics coating may be applied to hot panels which are then covered in particulate material which is mortar coloured. The panel is then masked with a stencil which has apertures therein that represent the bricks and a second layer of brick coloured powder is applied. This then sets so that finished panel resembles traditional brick work.

The process conditions such as the oven temperatures, conveyor speed, infra-red heater outputs, heights of heater above the tile etc. are selected to suit the particular powder coatings selected, the component geometry and material and can be changed accordingly to achieve optimum results. Such changes are within the sprit and scope of the present invention.

In a modified method a pre-heat oven (31) may used to pre-heat the tiles (10) or sheets before the first powder coating is applied.

I claim:

1. A method of manufacture of sheet building components having the appearance of a mineral, stone or ceramic material in which method the component is coated with a protective coating having a rough surface appearance caused by particulate material within the coating, said method comprising the steps of: applying a first layer of powder coating to the component, heating the component with the powder coating thereon to form a soft first layer, spreading particulate material onto said first layer while said first layer is in soft a condition, applying a second layer of powder coating over the particulate material and first layer, and causing the second layer of powder coating to coalesce.

2. A method as claimed in claim 1, wherein the particulate material comprises mineral dust or granular materials.

3. A method as claimed in claim 1, wherein the particulate material is dropped onto a heated and coated component as it is moved transversely relative to the falling particlate material so as to cover said component.

4. A method as claimed in claim 1, wherein the first layer of powder coating comprises thermoplastic polymeric powder which is caused to melt, and the second layer is a thermosetting powder coating which is cured.

5. A method as claimed in claim 1 wherein, the component is colored by spreading a colored particulate material thereon so as to impart a coloration to the coated component.

6. A sheet building component which is decorated to give the appearance of a mineral, stone, or ceramic material with at least a portion of a surface of said component having a varied surface pattern of raised and depressed portions and being coated by layers of polymeric material having particlate material embedded therein, said poylmeric material layers comprising a first layer of powder coated polymeric material having the particulate material scattered thereon, and a second layer of powder coated polymeric material coating both the first layer and the particulate material all said layers being of substantially uniform thickness on the raised and depressed portions.

7. A component as claimed in claim 6, wherein the second layer of powder coating polymeric material is a different material to the first layer of powder coating.

8. A component as claimed in claim 7, wherein the first layer is a thermoplastic powder coating and the second layer is a thermosetting powder coating.

9. A component as claimed in claim 6, wherein the particulate material is formed from at least one mineral taken form the group comprising crushed slate, marble, quartz, granite; or sand; or any mixture thereof.

10. A building component as claimed in claim 5 in the form of fabricated roofing sheet or roof tile on which said surface is an upper surface of a roof sheet or tile.

* * * * *